US008870092B2

(12) United States Patent
Yang et al.

(10) Patent No.: US 8,870,092 B2
(45) Date of Patent: Oct. 28, 2014

(54) VISCOSITY DRIVE DEVICE FOR ELEVATING-TYPE IN-GROUND SPRINKLER HEAD

(75) Inventors: Jiyue Yang, Guangdong (CN); Hongbin Huang, Guangdong (CN)

(73) Assignee: Guangdong Liansu Technology Industrial Co., Ltd., Foshan (CN)

( * ) Notice: Subject to any disclaimer, the term of this patent is extended or adjusted under 35 U.S.C. 154(b) by 472 days.

(21) Appl. No.: 13/320,450

(22) PCT Filed: Jan. 15, 2010

(86) PCT No.: PCT/CN2010/070211

§ 371 (c)(1),
(2), (4) Date: Nov. 14, 2011

(87) PCT Pub. No.: WO2011/079535

PCT Pub. Date: Jul. 7, 2011

(65) Prior Publication Data

US 2012/0048967 A1 Mar. 1, 2012

(30) Foreign Application Priority Data

Dec. 31, 2009 (CN) ..... 2009 1 0214545

(51) Int. Cl.
*B05B 3/04* (2006.01)
*B05B 15/06* (2006.01)

(52) U.S. Cl.
CPC ..... *B05B 3/0418* (2013.01); *B05B 15/062* (2013.01)
USPC ..... 239/237; 239/204

(58) Field of Classification Search
CPC ..... B05B 13/0484; B05B 13/0405
USPC ..... 239/237, 240, 203, 206, 380, 381
See application file for complete search history.

(56) References Cited

U.S. PATENT DOCUMENTS

| | | | | |
|---|---|---|---|---|
| 5,375,768 | A * | 12/1994 | Clark | 239/210 |
| 6,264,117 | B1 * | 7/2001 | Roman | 239/203 |
| 6,637,672 | B2 | 10/2003 | Cordua | |
| 6,883,727 | B2 | 4/2005 | De Los Santos | |
| 7,156,322 | B1 | 1/2007 | Heitzman | |
| 7,168,634 | B2 * | 1/2007 | Onofrio | 239/222.17 |
| 7,337,988 | B2 | 3/2008 | McCormick | |

FOREIGN PATENT DOCUMENTS

| | | | |
|---|---|---|---|
| CN | 85107997 | A1 | 4/1987 |
| CN | 100448549 | C | 1/2009 |

OTHER PUBLICATIONS

International Search Report for PCT/CN2010/070211, dated Oct. 8, 2010.

* cited by examiner

*Primary Examiner* — Davis Hwu
(74) *Attorney, Agent, or Firm* — Pearne & Gordon LLP

(57) ABSTRACT

A viscosity driving device for a lifting buried spraying head includes a cylindrical case (2), a filter (3) provided in the lower end of the case (2), and a spraying head driving unit disposed inside the case (2). The spraying head driving unit is connected with a spraying head positioned on the top end of the case (2) by means of a connecting shaft, and the spraying head driving unit drives the spraying head to rotate and spray water. The spraying head driving unit comprises a tangential flow generator (4) and a hydraulic rotator (5), and the hydraulic rotator (5) rotates under the action of viscosity of rotating water generated by the tangential flow generator (4) to drive the spraying head to rotate and spray water.

8 Claims, 3 Drawing Sheets

VISCOSITY DRIVE DEVICE FOR ELEVATING-TYPE IN-GROUND SPRINKLER HEAD

The present application is the national phase of International Application No. PCT/CN2010/070211, titled "VISCOSITY DRIVE DEVICE FOR ELEVATING-TYPE IN-GROUND SPRINKLER HEAD", filed on Jan. 15, 2010, which claims the benefit of priority to Chinese patent application No. 200910214545.1 titled "VISCOSITY DRIVE DEVICE FOR ELEVATING-TYPE IN-GROUND SPRINKLER HEAD", filed on Dec. 31, 2009. The entire disclosure thereof is incorporated herein by reference.

FIELD OF THE INVENTION

The invention relates to the field of water-saving irrigation fitting structures, in particular to a hydraulic driving device for a hydraulic lifting buried spaying head.

BACKGROUND OF THE INVENTION

Currently, injection pipe technology is adopted to meet water use requirements of places with high water consumption, such as urban green spaces, golf courses, etc. The traditional injection pipe product is complex in structure, having the structure that filtered water rushes at a multi-piece airfoil impeller positioned on an end surface at a certain angle to drive a main shaft to rotate, and a driving gear provided on the main shaft drives a nozzle to rotate after multi-grade gear pair deceleration, achieving the object of spraying. In this driving structure, excess gear pairs brings high difficulty for manufacture and assembly; especially high rotating speed of the driving gear requires high mounting accuracy of each gear shaft and high manufacturing accuracy of each gear shaft hole; and particularly, because module of each gear is small, which is merely 0.5 basically, there are high demands on the manufacturing accuracy and the assembly accuracy of the gears. Therefore, such driving structure has high manufacture cost. Because gears are in hard connections from the first gear to the nozzle, when water pressure changes, the rotational angular velocity of the spraying head fluctuates directly along with the fluctuation of water pressure and varies obviously; and frequently variation of water pressure will damage gear pairs at all levels.

SUMMARY OF THE INVENTION

The object of the invention is to provide a hydraulic driving device for a lifting buried spraying head with simple structure and convenient assembly and overcome the defects of the prior art.

The invention employs the following technical scheme to realize the above object:

A viscosity driving device for a lifting buried spraying head, comprises a cylindrical case, a filter provided in the lower end of the case, and a spraying head driving unit disposed inside the case. Wherein the spraying head driving unit is connected with a spraying head located on the top end of the case via a connecting shaft, and the spraying head driving unit drives the spraying head to rotate and spray water. The spraying head driving unit comprises a tangential flow generator and a hydraulic rotator. The tangential flow generator comprises a small case structure which is hollow, and forms a water supply gap with the inner wall of the case. Flow inlets are evenly distributed on the shell wall of the tangential flow generator along the circumferential direction, thus water come through the flow inlet rotates around the axle center. The hydraulic rotator is disposed inside the tangential flow generator and connected with the spraying head directly or indirectly via a connecting shaft, and the hydraulic rotator has cylindrical bearing surface which is corresponding to the flow inlets, and there is gaps exited between the bearing surface and the flow inlets, wherein the hydraulic rotator rotates, driven by rotating water through the cylindrical bearing surface.

The spraying head driving unit of the invention works based on cooperation of the tangential flow generator and the hydraulic rotator. Water filtered by the filter flows into the tangential flow generator from the flow inlets and rotates inside the tangential flow generator because of the specially arranged flow inlets of the tangential flow generator. The rotating water drives the hydraulic rotator to rotate under the action of viscosity and thus drive the spraying head to rotate and spray water.

In the above technical scheme, the spraying head driving unit further comprises a hydraulic driving disc and a nozzle driving disc. Wherein the hydraulic driving disc is positioned above the hydraulic rotator and coaxially connected with the hydraulic rotator, thus the hydraulic driving disc and the hydraulic rotator can rotate simultaneously. Wherein the nozzle driving disc is mounted above the hydraulic driving disc, and a gap is formed between the nozzle driving disc and the hydraulic driving disc in axial direction, and the nozzle driving disc is connected with the spraying head via a connecting shaft. With such structure, the spraying head driving unit adopts two-grade drive, in which the hydraulic rotator firstly drives the hydraulic driving disc to rotate, then the rotation of the hydraulic driving disc causes water in the gap between the hydraulic driving disc and the nozzle driving disc to rotate, and thus cause the rotation of the nozzle driving disc, and eventually the spraying head rotates and spray.

Furthermore, the main body of the said hydraulic driving disc is of a flat disc structure on which inflow holes are arranged; the main body of the nozzle driving disc is in a shape of cap and comprises a disc positioned right above the hydraulic driving disc and an outer ring positioned on the outer edge of the hydraulic driving disc. Water is injected into the gap between the nozzle driving disc and the hydraulic driving disc from the inflow holes and rotates along with the rotation of the hydraulic driving disc, and simultaneously drives the nozzle driving disc to rotate. The rotation of the nozzle driving disc driven by the hydraulic driving disc is also realized by the rotation of water within the gap between the hydraulic driving disc and the nozzle driving disc and by the viscosity of the rotating water.

In the invention, the connecting shaft used for connecting the hydraulic driving disc and the hydraulic rotator is mounted on a bracket, and the connecting shaft used for connecting the nozzle driving disc and the spraying head is mounted on the bracket as well, wherein the bracket is fixed on the inner wall of the case.

The tangential flow generator of the invention comprises a conical section and a cylindrical section, wherein the lower part of the conical section is provided with an annular hole, and the wall of the cylindrical section is provided with evenly distributed flow inlets.

Furthermore, the tangential flow generator comprises a sealing ring mounting groove positioned on the upper end of the cylindrical section, wherein a sealing ring for realizing sealing between the tangential flow generator and the inner wall of the case is mounted in the sealing ring mounting groove.

Wherein the hydraulic rotator comprises a cylindrical ring body, a central shaft hole positioned at the center of the cylindrical ring body, and shaft hole supporting ribs connected with the central shaft hole and the inner wall of the cylindrical ring body. The central shaft hole is provided with a connecting shaft, and the smooth outer surface of the cylindrical ring body is taken as a bearing surface.

Damping plates are evenly distributed on the inner wall of the cylindrical ring body.

The invention provides a novel spraying head driving structure in which a spraying head rotates under the action of tangential viscous force generated by water viscosity, especially the two grades of utilization of tangential viscous force generated by water viscosity. Wherein water current flowing in the tangential flow generator at the direction of tangent to periphery firstly drives the outer cylindrical surface of the hollow cylinder of the hydraulic rotator to rotate, which is as the driving cylinder; the driving cylinder further drives the hydraulic driving disc to rotate through a main shaft, and the hydraulic driving disc is thus act as a initiative disc. Because of the rotation of the initiative disc, water flow around the disc rotates due to the water viscosity, and then drives the nozzle driving disc, which is connected with a spraying head and concentric with the initiative disc and acts as a passive disc, to rotate. Such driving structure has two significant advantages: firstly, the driving structure has no gear pairs or airfoil impeller, but only with a liquid friction cylinder pair, a liquid friction disc pair and at most two shafts (one shaft connects the driving cylinder with the initiative disc, and the other shaft connects the passive disc with the spraying head, while traditional product has more gear shafts because of more gear pairs), and therefore, the manufacture and assembly process are greatly simplified; and secondly, because there is one grade of soft connection driven by water tangential force from the initiative cylinder to the spraying head, when water pressure changes, the variation of rotary speed of the passive shaft will delayed, so that the rotary speed variation of the spraying head is reduced.

DETAILED DESCRIPTION OF EMBODIMENT

The invention is further described here with drawings.

Figure 1:
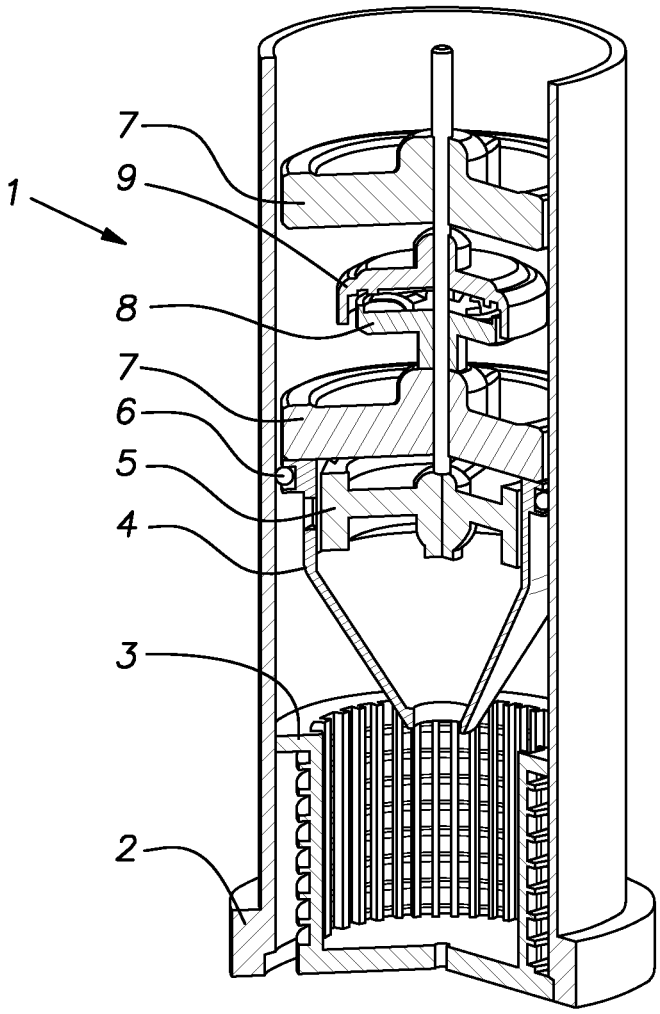
FIG. 1 is a structural diagram of the invention.

The structure of the invention is as follows:

Referring to FIG. 1, the driving device comprises a case 2, a filter 3, a tangential flow generator 4, a hydraulic rotator 5, a sealing ring 6, a bracket 7, a hydraulic driving disc 8 and a nozzle driving disc 9. The specific installation structure is as follows: the filter 3 is mounted at the inlet of the case 2; the tangential flow generator 4 is positioned downstream of the filter 3; the hydraulic rotator 5 is mounted inside the tangential flow generator 4; the sealing ring 6 is mounted on the tangential flow generator 4 and forms a sealing surface with the inner wall of the case 2; the hydraulic driving disc 8 is fixedly connected with the hydraulic rotator 5 by a shaft and positioned downstream of the hydraulic rotator 5, in which the shaft is fixed on the inner wall of the case 2 via a bracket 7; the nozzle driving disc 9 is mounted downstream of the hydraulic driving disc 8 and has a gap to the hydraulic driving disc 8 in the axial direction; the nozzle driving disc 9 is connected with a spraying head via a shaft and fixed on the inner wall of the case 2 via the bracket 7.

Figure 2A:
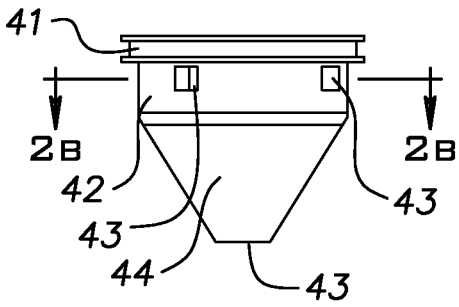
FIGS. 2A to 2D are structural diagrams of the tangential force generator.
Figure 2B:
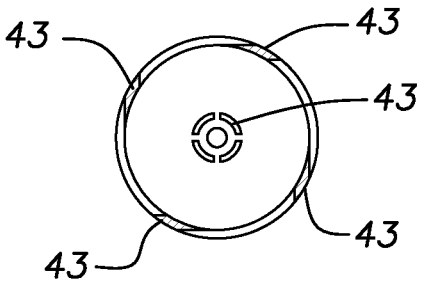
Figure 2C:
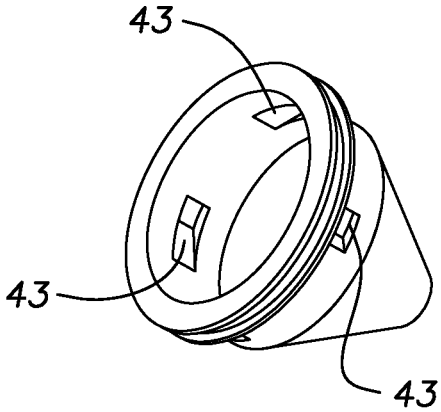
Figure 2D:
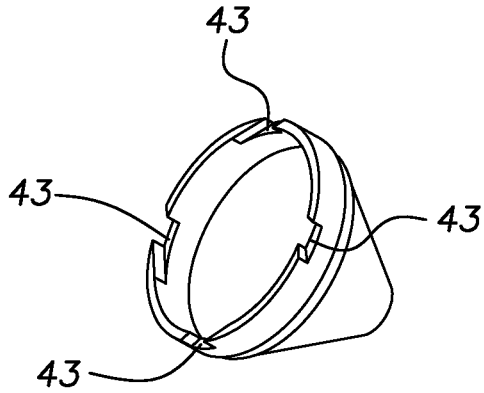

The tangential flow generator 4 is shown in FIGS. 2A to 2D, wherein FIG. 2A is a front view, FIG. 2B is a sectional view taken along section line 2B-2B of FIG. 2A, FIG. 2C is a side view of FIG. 2A, and FIG. 2D is a side view of FIG. 2B. The whole structure of the tangential flow generator is characterized by comprising a conical section 44, a cylindrical section 42 and a mounting groove 41 of the sealing ring 6 and is hollow inside. The lower end of the conical section 44 is provided with an annular hole 45. The wall of the cylindrical section 42 is evenly provided with a several flow inlets 43. The cross section of the flow inlets 43 can be a square, rectangle, circle or other shape. When the flow inlet 43 is a square or rectangle, the surface farthest away from the central axis is tangent to the inner wall of the cylindrical section 42; and when each inflow opening is a circle, ellipse or other shape, the generatrix of the farthest flow inlet from the central axis is tangent to the inner wall of the cylindrical section 42.

Figure 3:
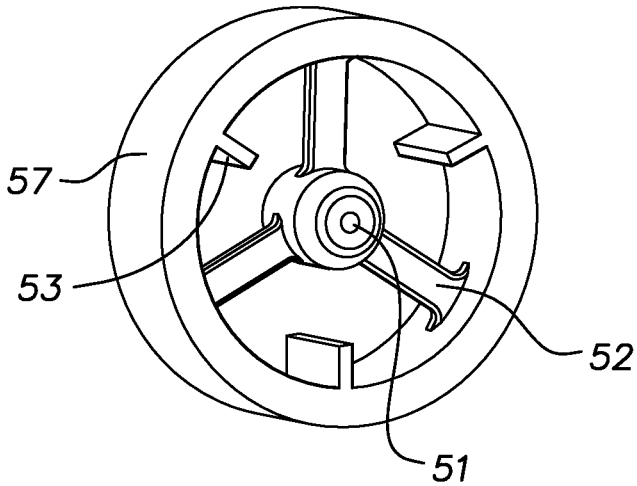
FIG. 3 is a structural diagram of the hydraulic rotator.

The hydraulic rotator 5 as shown in FIG. 3 is characterized in that the whole structure is a cylindrical ring comprising a central shaft hole 51, shaft hole supporting ribs 52 and several evenly distributed damping plates 53. Wherein damping plates 53 are flat plates, positioned on the inner wall of the cylindrical ring and points at the axle center. The smooth outer surface of the cylindrical ring is taken as a bearing surface 57 which is a cylindrical surface concentric with the shaft hole.

Figure 4:
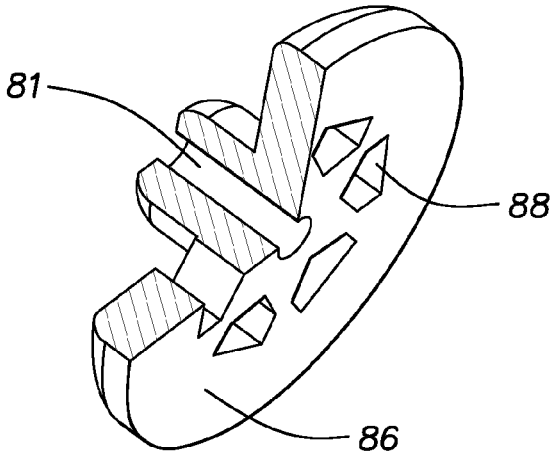
FIG. 4 is a structural diagram of the hydraulic driving disc.

The hydraulic driving disc 8 as shown in FIG. 4 has the whole structure of a disc comprising a shaft hole 81, several evenly distributed inflow holes 82 and a swirling flow flat plate 86. Said swirling flow flat plate 86 is perpendicular to the shaft hole 81; said inflow holes 82 are positioned on the swirling flow flat plate 86, and is near to the shaft hole 81 and parallel to the shaft hole 81, and completely penetrate through the swirling flow flat plate 86.

Figure 5:
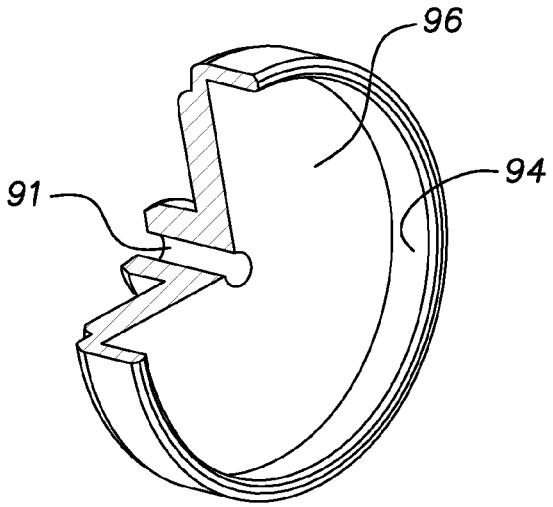
FIG. 5 is a structural diagram of the nozzle driving disc.

The nozzle driving disc 9 as shown in FIG. 5 has the whole structure of a disc comprising a shaft hole 91, a base-plate 96 and an outer ring 94. Said base-plate 96 is perpendicular to the shaft hole 91, the outer ring is positioned on the base-plate 96 and at the edge of the base-plate 96.

Figure 6:
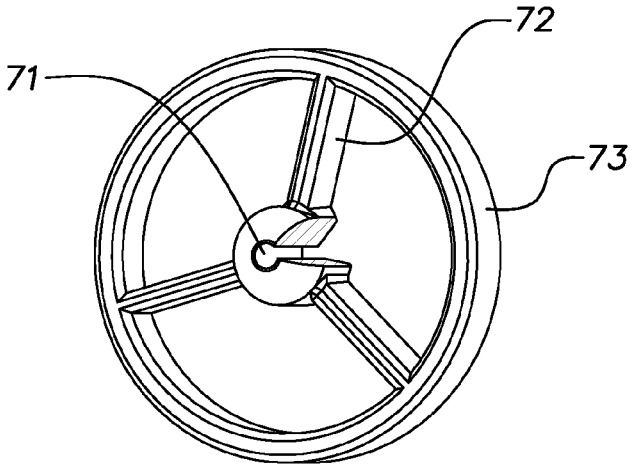
FIG. 6 is a structural diagram of the bracket.

The support bracket 7 as shown in FIG. 6 comprises a shaft hole 71, several evenly distributed brackets 72 and support ring 73.

The invention has the following working process:

Water is divided into two part after passing through the filter 2, one part directly enters the tangential flow generator 4 through the annular hole 45 of the tangential flow generator 4, the other part flows through the external surface of the tangential flow generator 4 and then enters the tangential flow generator 4 from the tangential flow inlets 43, and rotates along the inner wall surface of the cylindrical section 42 of the tangential flow generator 4. The rotating water drives the bearing surface 57 of the hydraulic rotator 5 to rotate under the action of the tangential force produced by the viscosity, and thus the hydraulic rotator 5 rotates. When water pressure is overhigh or fluctuating, because water entering the tangential flow generator 4 from the annular hole 45 of the tangential flow generator 4 flows along the axis, rotating damping moment generated by the damping plates 53 of the hydraulic rotator 5 to the hydraulic rotator 5 changes and thus ensures the small variation of the rotational angular velocity of the hydraulic rotator 5.

The two parts of the water in the tangential flow generator 4 continue flow downstream, the hydraulic driving disc 8 is fixedly connected with the hydraulic rotator 5 via a shaft, and when the hydraulic rotator 5 rotates, the hydraulic driving disc 8 is driven to rotate. A part of water flows in the gap between the hydraulic driving disc 8 and the nozzle driving disc 9 from the inflow holes 82 on the hydraulic driving disc 8, the swirling flow flat plate 86 of the hydraulic driving disc 8 causes the water in the gap to rotate by means of the tangential force produced by viscosity of the water, and the rotating water drives the base-plate 96 of the nozzle driving disc 9 to rotate under the action of the tangential force produced by viscosity of the water such that the spraying head is driven to rotate.

The invention claimed is:

1. A viscosity driving device for a lifting buried spraying head comprising a cylindrical case (2), a filter (3) provided in the lower end of the case (2), and a spraying head driving unit which is disposed inside the case (2), wherein the spraying head driving unit is connected with a spraying head positioned on the top of the case (2) via a connecting shaft, and the spraying head driving unit drives the spraying head to rotate and spray water, wherein the spraying head driving unit comprises a tangential flow generator (4) and a hydraulic rotator (5), wherein the tangential flow generator (4) has a small case structure which is hollow, and forms a water supply gap with the inner wall of the case (2); flow inlets (44) are evenly distributed on the shell wall of the tangential flow generator (4) along the circumferential direction, thus water come through the flow inlet (44) rotates around the axle center; the hydraulic rotator (5) is disposed inside the tangential flow generator (4) and connected with the spraying head directly or indirectly via connecting shaft, and the hydraulic rotator (5) has a cylindrical bearing surface (57) corresponding to the flow inlets (44), and there is gaps exited between the bearing surface (57) and the flow inlets (44), wherein the hydraulic rotator (5) rotates, driven by rotating water through the cylindrical bearing surface (57).

2. The driving device as claimed in claim 1, wherein the spraying head driving unit further comprises a hydraulic driving disc (8) and a nozzle driving disc (9), wherein the hydraulic driving disc (8) is positioned above the hydraulic rotator (5), and coaxially connected with the hydraulic rotator (5), and rotates simultaneously with the hydraulic rotator (5); wherein the nozzle driving disc (9) is mounted above the hydraulic driving disc (8), a gap is formed between the nozzle driving disc (9) and the hydraulic driving disc (8) in the axial direction, and the nozzle driving disc (9) is connected with the spraying head via a connecting shaft.

3. The driving device as claimed in claim 2, wherein the main body of spraying head driving disc (8) is of a flat disc structure on which inflow holes (82) are arranged; the main body of the nozzle driving disc (9) is in a shape of cap and comprises a disc positioned right above the hydraulic driving disc (8) and an outer ring positioned on the outer edge of the hydraulic driving disc (8); water is injected into the gap between the nozzle driving disc (9) and the hydraulic driving disc (8) from the inflow holes (82) and rotates along with the rotation of the hydraulic driving disc (8), and simultaneously drives the nozzle driving disc (9) to rotate.

4. The driving device as claimed in claim 2, wherein the connecting shaft used for connecting the hydraulic driving disc (8) and the hydraulic rotator (5) is mounted on a bracket (7), and the connecting shaft used for connecting the nozzle driving disc (9) and the spraying head is mounted on the bracket (7) as well, wherein the bracket (7) is fixed on the inner wall of the case (2).

5. The driving device as claimed in claim 1, wherein the tangential flow generator (4) comprises a conical section (44) and a cylindrical section (42), wherein the lower part of the conical section (44) is provided with an annular hole (45), and the wall of the cylindrical section (42) is provided with evenly distributed flow inlets (43).

6. The driving device as claimed in claim 5, wherein the tangential flow generator (4) further comprises a sealing ring mounting groove (41) positioned on the upper end of the cylindrical section (42), wherein a sealing ring (6) for realizing sealing between the tangential flow generator (4) and the inner wall of the case (2) is mounted in the sealing ring mounting groove (41).

7. The driving device as claimed in claim 1, wherein the hydraulic rotator (5) comprises a cylindrical ring body, a central shaft hole (51) positioned at the center of the cylindrical ring body, and shaft hole supporting ribs (52) connected with the central shaft hole (51) and the inner wall of the cylindrical ring body, wherein a connecting shaft is mounted in the central shaft hole (51), and the smooth outer surface of the cylindrical ring body is taken as a bearing surface (57).

8. The driving device as claimed in claim 7, wherein damping plates (53) are evenly distributed on the inner wall of the cylindrical ring body.

* * * * *